US007677988B2

(12) United States Patent
McMillan

(10) Patent No.: US 7,677,988 B2
(45) Date of Patent: Mar. 16, 2010

(54) TRAINING DEVICE FOR GOLFERS

(76) Inventor: Vern McMillan, 111 Powell Street, Yarraville, Victoria 3013 (AU)

( * ) Notice: Subject to any disclaimer, the term of this patent is extended or adjusted under 35 U.S.C. 154(b) by 48 days.

(21) Appl. No.: 10/553,768

(22) PCT Filed: Apr. 28, 2004

(86) PCT No.: PCT/AU2004/000542

§ 371 (c)(1),
(2), (4) Date: Feb. 21, 2006

(87) PCT Pub. No.: WO2004/096382

PCT Pub. Date: Nov. 11, 2004

(65) Prior Publication Data

US 2006/0205528 A1 Sep. 14, 2006

(51) Int. Cl.
*A63B 69/36* (2006.01)

(52) U.S. Cl. ..... 473/278; 473/266

(58) Field of Classification Search ..... 473/266, 473/269, 270–273, 278–279, 452
See application file for complete search history.

(56) References Cited

U.S. PATENT DOCUMENTS 2,455,274 A * 11/1948 Scriver ..... 482/71
3,584,871 A * 6/1971 Kelmon et al. ..... 482/123
4,023,810 A * 5/1977 Lorang ..... 473/218
4,522,392 A * 6/1985 Torii ..... 482/128
4,560,165 A * 12/1985 Witteman et al. ..... 473/269
4,861,054 A * 8/1989 Spital ..... 280/221
4,913,442 A 4/1990 Walker
5,000,457 A 3/1991 Brown
5,224,913 A * 7/1993 Rodibaugh ..... 482/124
5,888,147 A 3/1999 Luedtke
5,976,027 A * 11/1999 Kachmar ..... 473/273
6,280,366 B1 * 8/2001 Hsieh ..... 482/130
6,569,041 B1 * 5/2003 Riivald ..... 473/446
2002/0151416 A1 * 10/2002 List ..... 482/121

FOREIGN PATENT DOCUMENTS

GB 2095564 A 10/1982

* cited by examiner

*Primary Examiner*—Nini Legesse
(74) *Attorney, Agent, or Firm*—Edwin D. Schindler

(57) ABSTRACT

An apparatus for assisting in training players of golf includes a platform and a first coplanar foot support member and a second coplanar foot support member on the platform, with the first coplanar foot support member being fixed in position and the second coplanar foot support member able to be moved laterally and linearly on the platform relative to the first coplanar foot support member when a golf player places one foot on each of the two coplanar foot support members. A biasing device causes the second coplanar foot support member to be adjacent the first coplanar foot support member, so that in the absence of an externally applied force, the second coplanar foot member remains adjacent to the first coplanar foot support member.

6 Claims, 2 Drawing Sheets

TRAINING DEVICE FOR GOLFERS

TECHNICAL AREA

The invention relates to the area of training devices for various sports and in particular to a device for training golfers, providing a means by which golfers are able to stabilise the lower half of their body giving a firm, secure stance for the swing to be carried out.

While the invention relates to a training device which is suitable for use in any sport requiring hitting or pitching of the ball, for convenience sake it will be discussed herein in terms of training for golfers.

BACKGROUND OF THE INVENTION

Over the years there have been many inventions which have been devised to teach or correct a golfer's swing. The golf swing can be broken down into three basic phases: take-away, impact and follow through. Balance is essential in the follow through of a golf swing and is generally achieved with proper swing mechanics which occurs in the first two phases of the golf swing. For this to occur it is imperative that the lower part of the body be stabilised to prevent any unwanted vertical motion.

Erroneous swing mechanics can lead to an increase incidence of injury that is resultant from uncontrolled and misdirected shots. An incorrect balance of weight in the lower part of the body can cause a variety of errant shots including fat (striking ground first) and thin (striking only ball and no turf) shots. Other common swing faults pertinent to golfers, include right knee lateral sway, vertical motion, excessive lower body motion in the short game ie. Chipping and putting, and extra long swings.

Current devices that attempt to control the movement of the player's body are generally overly restrictive, complicated and inaccurate in the movement defined. The devices are designed to restrict the body movement of the player by securing or immobilising various parts of the body such as the head, waist, shoulders, arms or legs. However, often the devices are cumbersome and awkward including multi-strap hand or leg braces that are uncomfortable and require a fair amount of time to adjust their position. In addition, whilst these may support the players and guide their movement, the devices hinder the development and movement of supporting muscles which would otherwise occur if the player were self supported.

The previous devices fail to provide a method whereby the swing of a golfer can be easily and conveniently controlled in a round of golf, such that the golfer can adjust the stance throughout a round of golf depending on the characteristics of a particular golfer and environmental conditions such as variations in the inclination of a course, without the need to readjust settings or positioning of the device.

OUTLINE OF THE INVENTION

It is an object of the present invention to overcome or substantially ameliorate the disadvantages of the prior art by providing a device for controlling and stabilising the body movement of a golfer in order to ensure a controlled and consistent golf swing.

It is a further object of the invention to provide a means whereby the device provides a constant reference to which the player may return in order to repeat the same motion.

It is a further object of the invention to provide a means for exercising to strengthen the necessary muscles which enables a player to approximate the desired motion without the direct pressure of the device.

The invention provides, for use in the training of golf players, a device having a platform and two coplanar members situated thereon, wherein the first member is fixed, and the second member may move relative to the first member, the device having a bias means which, in the absence of an externally applied force, causes the two members to be adjacent.

It is preferred that the second member is arranged in a manner where it is able to slide relative to the first member.

It is further preferred that the bias means which causes the members to be adjacent in the absence of an external force is at least one spring means.

It is further preferred that the bias means may be at least one elasticised member.

It may be preferred that there is a third member which can be located transversely of the first and second members which can receive a golf ball.

In order that the invention be more readily understood we will describe by way of non limiting example a specific embodiment thereof.

BRIEF DESCRIPTION OF THE DRAWING FIGURE

DESCRIPTION OF AN EMBODIMENT OF THE INVENTION

Figure 1:
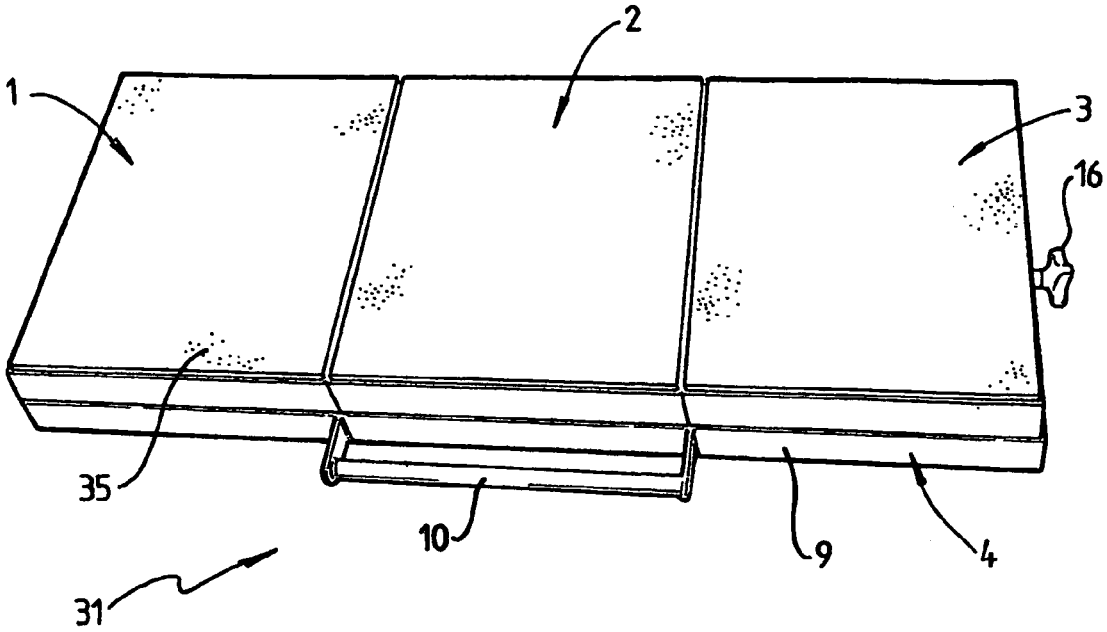
FIG. 1 is a perspective view of an embodiment of the training device showing all members secured in place on the platform.
Figure 2:
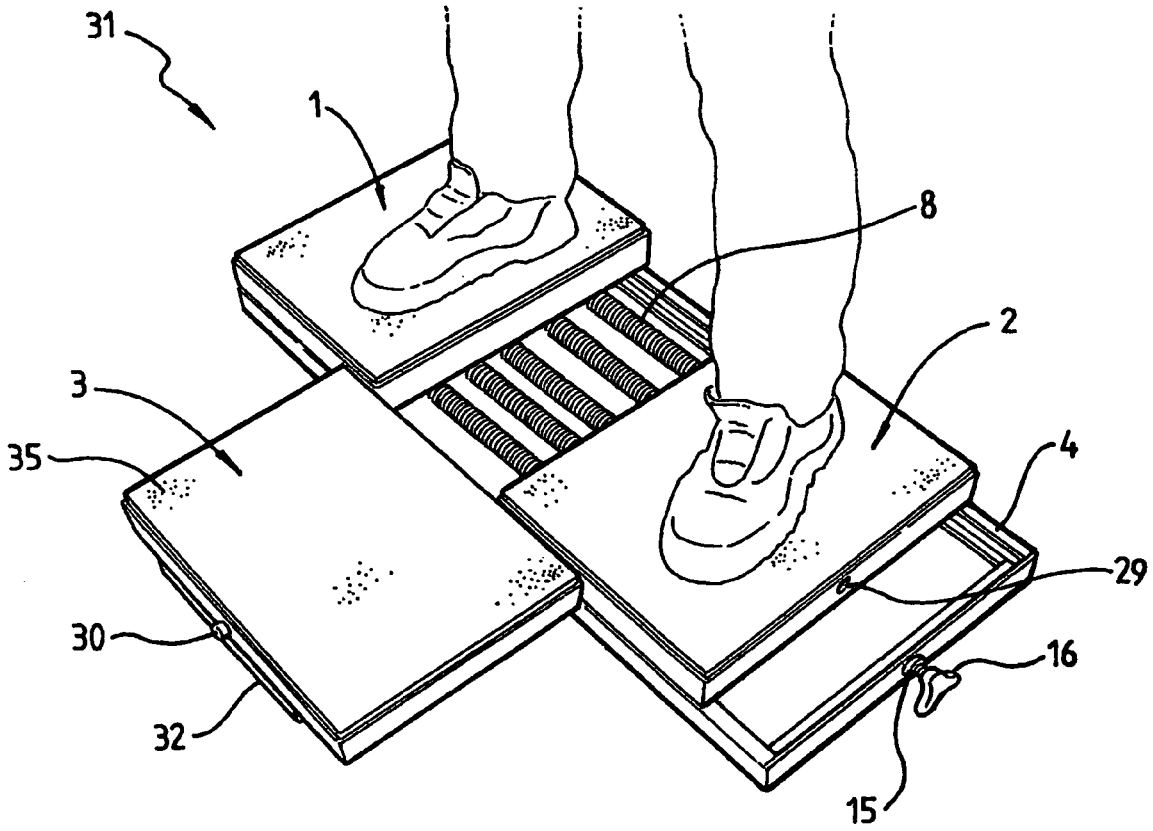
FIG. 2 is a perspective view of an embodiment of the training device showing the spring mechanism which stabilises the body.
Figure 3:
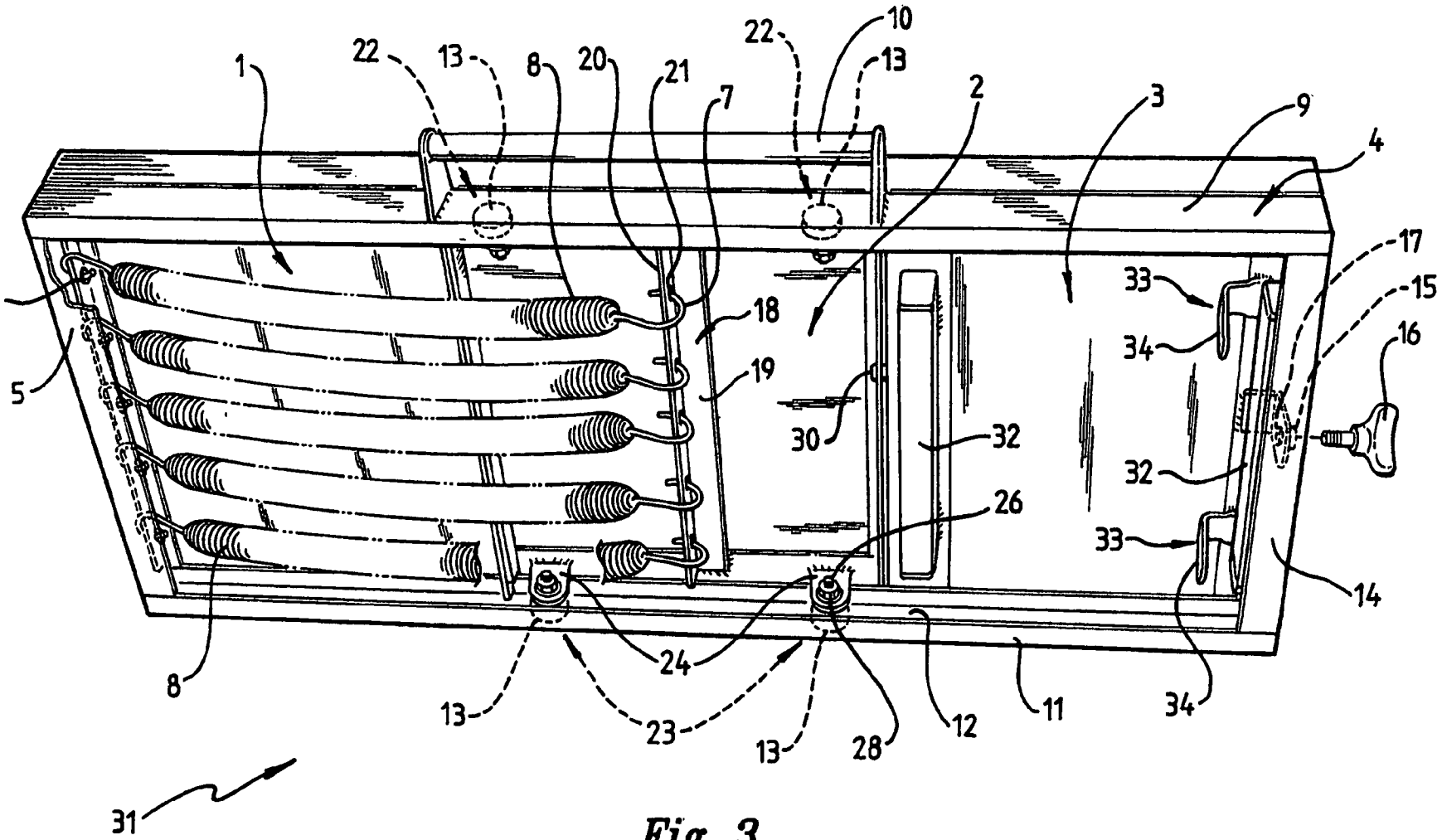
FIG. 3 is a perspective view of an embodiment of the training device according to the invention showing the underside of the device.

FIGS. 1 to 3 show a preferred embodiment of the invention as it relates to a device for training golfers.

In this embodiment of the invention, the device comprises a platform (4) having three members (1,2,3) wherein one member is a fixed member (1), one is a sliding member (2) and the other is a removable member (3). The platform (4) is a rectangular frame with the dimensions of the frame being equivalent to that of the three platform members (1,2,3) when they are placed horizontally adjacent to each other, so that when the platform members (1,2,3) are placed onto the platform (4) the outside edge of the platform members (1,2,3) is in line with the edge of the frame of the platform (4).

On the lower left side of the frame (5) are provided five holes (6) spaced at even intervals apart, adapted to receive the hooks (7) of spring members (8) and secure them to the frame. Directly above the left side of the frame (5) sits the fixed member (1) which is permanently attached to the platform frame (4) and acts as a reference and support for the slidable member (2) to stretch away from.

The front face of the frame (9) has a handle (10) which serves as a means for making the device portable when it is fully assembled and easy to transport with the player.

Provided on the inner side of the frame (11), is a roller track assembly (12) adapted to receive the rollers (13) which are attached to the underside of the sliding member (2). The edge of the platform (4) itself serves as being the end of the track (12) and consequently, as a means for stopping the roller(s) (13) from sliding any further.

On the right hand side of the frame (14) is an aperture (15) and rotatable screw member (16) which can pass through the aperture (15) and aperture (17) provided on the side of the removable member (3) and is adapted to be tightened or loosened to secure or remove the member (3) accordingly.

The sliding member (2) is positioned in the middle of the platform lying directly behind the handle (10) on the front face (9) of the platform (4). Underneath the sliding member (2) spanning vertically across the centre of the sliding member (2) is a L-shaped strip (18), wherein an upper portion (19) of the strip (18) is fixed to the underside of the member (2) at either end. The lower portion (20) of the strip (18) extends vertically downwards from the sliding member (2) and has provided five holes (21) spaced at even intervals, adapted to receive a hook (7) from a spring member (8). The holes (21) are spaced such that they correspond with the holes (6) provided on the left side (5) of the platform (4) when the sliding member (2) is in place.

Attached underneath the frame of the sliding member (2) are two front roller assemblies (22) and two back roller assemblies (23). The roller assemblies (22,23) consist of a securing member (24) fixed to the bottom of the frame of the sliding member (2), wherein the securing member (24) has an aperture adapted to receive a bolt (26) from one side of the roller (13), with a washer and nut (28) being able to be tightened from the other side of the securing member (24) to secure the roller (13) in place.

On the right side of the frame of the sliding member (2) is an aperture (29) adapted to receive a connector member (30) provided on the removable member (3) when it is slid into place adjacent to the sliding member (2).

The sliding member (2) is spring-loaded and is attached to the platform (4) by springs (8). The number of springs (8) may be varied to suit the physical characteristics of the person using the device (31) whereby the greater amount of springs (8) connected, the more tension is applied to the device (31).

The removable member (3) has two rectangular rods (32) fixed to the underside of its frame and two L-shaped stand members (33) fixed underneath the right side of its frame. The height of the rods (32) and downwardly protruding side (34) of the stand members (33) are the same as that of the platform (4) so that when it is removed and placed horizontally to lie adjacent to the front face (9) of the platform (4), the removable member (3) will be at the same height as rest of the platform (4) so that, if a player is standing on the device (31) and practising their swing in a real situation, there is a place for a ball to be place thereon. Positioning of the ball and guiding of the swing may aided by outlines provided on the surface of the members (1,2,3).

Situated on the left side of the frame of the removable member (3) is a round connector member (30) which protrudes outwardly from the side of the frame and slides into the receiving aperture (29) in the sliding member (2) when the two members (2,3) are aligned vertically adjacent to each other in the platform assembly (4).

The surface (35) of the members (1,2,3) is designed to be interchangeable such that, a person can choose which material is most comfortable to them as some people may prefer a harder or softer surface. Accordingly, a surface made from marine carpet, golf matting, or rubber or any other suitable material may be used.

In practice, the removable member (3) is taken and placed in front of the platform to serve as a means for placing the ball thereon so that the ball may be hit. The player then stands on the platform (4), having the fixed member (1) a and sliding member (2) in place, facing toward the front so that one foot is positioned on the fixed member (1), and the other foot is positioned on the sliding member (2). The player then slides the sliding member (2) across, an action which immediately triggers a reaction within the central nervous system, and sends into effect a particular motor pattern to stabilise the lower half of the body that is moving.

The correct stance produced as a result of this reaction mechanism is in fact the ideal stance to be adopted when conducting a golf swing. The lower body is firmly stabilised to restrict any wobbling in the top half of the body so that the player can concentrate his focus of maintaining a controlled and accurate swing throughout the shot. The device (31) makes you hold this stance because if you do not the sliding member (2) will spring back and you will fall over.

The device (31) further provides a constant reference to which the player may return in order to repeat the same motion. This makes the device (31) appropriate as a teaching device and also as an exercise device.

The device (31) can also be used for exercises which work on the muscles which obtain that stability in order to stop the initial instability that is experienced when the stance is first taken so that eventually the player will be able to step out onto the course and automatically adopt that secure and controlled stance without any training aids. In addition, the device is also capable of accommodating left or right swing players.

Whilst we have described herein a specific embodiment of the invention it is to be understood that variations and modifications in this can be made without departing from the scope thereof.

The claims defining the invention are as follows:

1. An apparatus for assisting in training players of golf, comprising:

a platform;

a first coplanar foot support member and a second coplanar foot support member on said platform, with said first coplanar foot support member being fixed in position and said second coplanar foot support member laterally movable on said platform relative to said first coplanar foot support member;

means for biasing said second coplanar foot support member to be adjacent said first coplanar foot support member, wherein absent an externally applied force, said second coplanar foot support member remains adjacent said first coplanar foot support member; and, a third coplanar foot support member located transversely of said first coplanar foot support member and said second coplanar foot support member and capable of receiving a golf ball thereon.

2. The apparatus for assisting in training players of golf according to claim 1, wherein said third coplanar foot support member is removable.

3. The apparatus for assisting in training players of golf according to claim 1, wherein said first coplanar foot support member, said second coplanar foot support member and said third coplanar foot support member each have a removable surface with each said removable surface being interchangeable with one another.

4. An apparatus for assisting in training players of golf, comprising:

a platform;

a first coplanar foot support member and a second coplanar foot support member on said platform, with said first coplanar foot support member being fixed in position and said second coplanar foot support member laterally and linearly movable on said platform relative to said first coplanar foot support member;

means for biasing said second coplanar foot support member to be adjacent said first coplanar foot support member, wherein absent an externally applied force, said second coplanar foot support member remains adjacent said first coplanar foot support member; and, a third coplanar foot support member located transversely of said first coplanar foot support member and said second coplanar foot support member and capable of receiving a golf ball thereon.

5. The apparatus for assisting in training players of golf according to claim 4, wherein said third coplanar foot support member is removable.

6. The apparatus for assisting in training players of golf according to claim 4, wherein said first coplanar foot support member, said second coplanar foot support member and said third coplanar foot support member each have a removable surface with each said removable surface being interchangeable with one another.

* * * * *